US006453774B1

(12) United States Patent
Khachatoorian

(10) Patent No.: US 6,453,774 B1
(45) Date of Patent: Sep. 24, 2002

(54) TOOL FOR REMOVING ROOFING SHINGLES

(75) Inventor: Zareh Khachatoorian, Northridge, CA (US)

(73) Assignee: Olympia Group, Inc., City of Industry, CA (US)

( * ) Notice: Subject to any disclaimer, the term of this patent is extended or adjusted under 35 U.S.C. 154(b) by 0 days.

(21) Appl. No.: 09/693,457

(22) Filed: Oct. 20, 2000

(51) Int. Cl.[7] ..... E04D 15/00

(52) U.S. Cl. ..... 81/45; 254/131.5; 30/169; 299/36.1

(58) Field of Search ..... 81/45; 254/131.5; 30/169, 172; 299/36.1; 294/49, 55

(56) References Cited

U.S. PATENT DOCUMENTS 3,134,574 A * 5/1964 Reuterfors ..... 7/166 X
5,496,015 A * 3/1996 Carmien ..... 254/131.5
5,813,295 A * 9/1998 Jensen ..... 81/45
5,836,222 A * 11/1998 Harpell ..... 81/45
5,893,304 A * 4/1999 Carroll ..... 254/131.5 X
6,029,545 A * 2/2000 Harpell ..... 81/45

* cited by examiner

*Primary Examiner*—James G. Smith
(74) *Attorney, Agent, or Firm*—Lackenbach Siegel, LLP

(57) ABSTRACT

A shingle removal tool includes a cutting head attached to a handle, the cutting head having a flat leading portion on which a series of nail engaging slots are formed creating a series of sharp tapered cutting edges at a leading end and a fulcrum edge at a trailing edge. An intermediate portion integrally connects the flat leading portion with the handle. The intermediate portion is curved preferably in the form of an arc of a circle to provide a concave inner surface that imparts a curvature to the lifted shingles and propels them in the direction of advancement of the tool and away from the user. A nail removing opening is provided on the intermediate portion so that larger nails can be removed by lifting the handle which smaller nails can be sheared off by the cutting edges or lifted by the engaging slots by lowering the handle. The tool is ergonomicaly dimensioned to facilitate use by users of average height with confortable and limited movements to increase efficiency of use and to minimize fatigue.

18 Claims, 4 Drawing Sheets

TOOL FOR REMOVING ROOFING SHINGLES

BACKGROUND OF THE INVENTION

1. Field of the Invention

This invention generally relates to tools and, more specifically, to a tool for removing roofing shingles.

2. Description of the Prior Art

Normally, before a new roof can be installed on a building structure, the damaged roof is removed. When a shingle roof is replaced, the old shingles are normally discarded and replaced by new shingles. For this reason, it is normally desirable to remove the old shingles in the quickest, most convenient and most inexpensive way. Since such shingle removal is a labor intensive process, numerous shingle-removing tools have been devised for assisting a roofer in removing the old roof-covering materials.

The outer layers of a typical roof are formed of roofing shingles that are somewhat flexible and provided with a series of shingles that overlie, in staggered fashion, a lower course of like or similar shingles. Each portion of the roofing surface is thus covered by a plurality of layers formed, initially, by roofing felt or roofing paper and then by a first layer of shingles. In some instances, if a roof is re-shingled, a second layer of shingles is placed over the solid portion of the first shingles and over their flaps. When shingles become damaged, it is usually not possible to add a third layer of shingles since the strength of the roofing structure may not be able to support the weight of a third layer of shingles. It is therefore necessary to remove the shingles that are already on the roof, and this sometimes includes two layers of shingles.

The shingles are nailed to the roof with roofing nails that have wide, flat heads so that they can securely hold the soft shingle material. The nails are frequently invisible, as they are covered by the shingles to protect the nails from the elements. Thus, the nails retaining one course of shingles will be typically covered by the next course of shingles. Due to the manner in which such shingles are applied, it is not possible to merely raise one flap of a shingle to obtain access to the nails. The flaps frequently hide them, and it is difficult and inconvenient to obtain access to such nails. Removing shingles can be very a time-consuming and tedious task. While the shingles may be removed from the top down, that is, in the reverse order from the initial shingling of the roof, obtaining access to the nails and prying them up on a nail-by-nail basis, especially if two layers of shingles are to be removed, is extremely time-consuming and not customary in the field. Pry bars of various designs have been proposed, arranged to fit the neat layers of shingles or between the roof and layers of shingles so that a group of nails can be pried up from the roofing boards one at a time.

While numerous shingle removing tools have been proposed, such tools have suffered from various drawbacks in actual practice. Thus, for example, some such removal tools have not provided optimum leverage or mechanical advantage at the tip edge of the blade to quickly and conveniently remove shingles with an optimum amount of force and handle deflection or movement. Clearly, it is desirable to optimize the design of the tool to provide such leverage that it minimizes fatigue to the user. This is especially important when the shingles are to be removed from a large roof. When such leverage is not optimized, this can become a very physically demanding operation.

Also, such shingle or tile removal tools normally include a leading flat portion which is intended to be oriented substantially parallel to the surface on which the shingles or tiles are connected. However, the orientation of the leading edge of the head of the tool will be a function of a number of factors. Such factors include the angular orientation between the handle and the leading edge of the tool, the length of the handle and the height at which the user holds the handle in relation to the surface on which the tiles are mounted. The latter factor will also tend to be a function of how tall the user is, and whether the user holds the handle in a position that is most normal for the user during use, or whether the user is compelled to artificially raise or lower the tool during use, which can be an uncomfortable and tiring posture for the user. Since the orientation of the flat forward portion of the head of the tool is important to optimize the tool's penetration beneath the tiles and to minimize friction forces on the tool itself, a properly designed tool can reduce fatigue and enhance removal efficiency.

Also, while most roofing nails are sufficiently short that they can be pulled by a roofing tool of the type under discussion, using normal manipulations of the tool, there are nails on occasion that are too long and the relatively short movements by the tool element that engages the nails are not sufficient to fully remove such nails. In these instances, a worker needs to carry a separate tool, such as a crowbar to remove such nails. This has complicated the work and made it less efficient.

Another problem that is frequently encountered with such tools is that most such tools frequently cause the shingles to climb up the blade and fall to the back of the blade. Such movements of the shingles make their removal more difficult and tedious, particularly when the shingles crack or break during removal, which further requires the handling of numerous additional sections of fragmented shingles. With prior art tools the fragments are propelled towards the worker, requiring separate collection of the fragments for disposal. Again, this makes the work more tedious and less efficient.

SUMMARY OF THE INVENTION

Accordingly, it is an object of the present invention to provide a tool for removing roofing shingles which does not exhibit the disadvantages inherent in prior art tools.

It is another object of the invention to provide a tool for removing roofing shingles which is simple in construction and economical to manufacture.

It is still another object of the invention to provide a tool as in the previous objects which is easy and convenient to use.

It is yet another object of the present invention to provide a tool of the type under discussion which can deflect removed shingles in the forward direction in which the tool is being moved to allow the shingles to be accumulated in a sweeping action for ultimate collection and disposal.

It is a further object of the invention to provide a tool as aforementioned which reduces sliding friction and efficiently converts the efforts by the user into forward and lifting motions.

It is still a further object of the invention to provide a tool for removing roofing shingles which can remove roofing nails typically used for securing the shingles to the roof, as well as for removing longer nails, the lengths of which are greater than the prying movements of the leading edge of the tool.

It is yet a further object of the invention to provide a tool for removing roofing shingles as aforesaid, which is ergonomic for use by most individuals, being dimensioned for optimum maneuverability by a person of average height.

It is yet another object of the invention to provide a removal tool as suggested in the previous objects which can quickly and conveniently remove both small and large roofing nails.

In order to achieve the above objects, as well as others which will become apparent hereinafter, a shingle removal tool in accordance with the present invention for removing shingles secured to a surface by means of nails, includes an elongate handle defining a handle axis and provided with gripping means at one axial end of the handle for facilitating the gripping of the handle by a user. A cutting head is generally aligned with such handle axis and has an upper end secured to the other axial end of said handle. A lower end of said cutting head is formed with a generally flat leading portion integrally connected to said upper end by means of an intermediary portion. Said flat leading portion defines a leading edge generally transverse to said handle axis and formed with a plurality of spaced-apart slots open at their leading edge and extending rearwardly of said leading edge and dimensioned and configured to receive and engage nails once said leading portion is in contact with and slides forwardly along said surface and engages secured shingles. Said leading and intermediary portions are angularly offset from each other to form a fulcrum edge generally parallel to the leading edge, as to orient said handle axis at a predetermined angle in relation to said surface when said flat leading portion lies flat on said surface. Said fulcrum edge serves to raise said leading edge above said surface by lowering the inclination of said handle below said predetermined angle to lift the shingles and/or nails in contact with said leading portion. Said intermediary portion is curved in a plane extending through said handle axis and normal to said flat leading portion to form a concave upper surface defining normal directions from said fulcrum edge to said upper end that increasingly approach the orientation of the plane of said flat leading portion.

In accordance with another feature of the invention, a nail-engaging means is provided on said intermediate portion spaced a predetermined height above said flat leading portion for engaging and removing nails, generally nails that are larger than nails intended to be removed by said flat leading portion, by lifting said handle about said fulcrum edge.

In accordance with still another object of the present invention, said flat leading and intermediate portions are dimensioned and configured so that said handle axis intersects said flat leading portion at a point substantially midway between said leading and fulcrum edges.

According to yet another feature of the present invention, said predetermined angle of said handle axis is selected to be within the range of 45°–55° for dimensions between said fulcrum edge to said gripping means, generally along a direction normal to said surface, while said leading portion lies flat on said surface, within the range of 25 and 35 inches. In order to further enhance the efficiency in the use of the tool, in accordance with another feature of the invention, the ratio of the dimensions between said leading and fulcrum edges and said fulcrum edge to said gripping means, generally along said handle axis, is approximately within the range of 0.07 and 0.08.

BRIEF DESCRIPTION OF THE DRAWINGS

With the above and additional objects and advantages in view, as will hereinafter appear, this invention comprises the devices, combinations and arrangements of parts hereinafter described by way of example and illustrated in the accompanying drawings of preferred embodiments in which.

DESCRIPTION OF THE PREFERRED EMBODIMENTS

Figure 1:
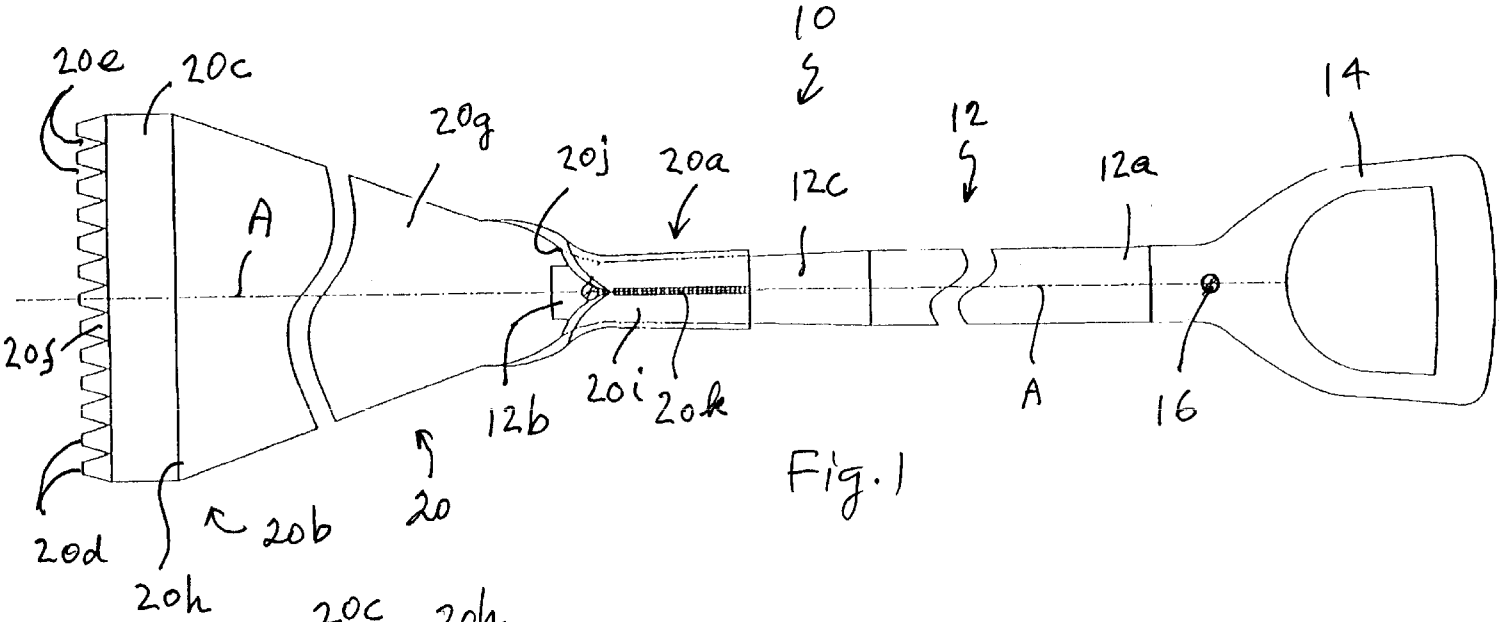
FIG. 1 is a bottom plan view of the tool for removing roofing shingles in accordance with the present invention.
Figure 2:
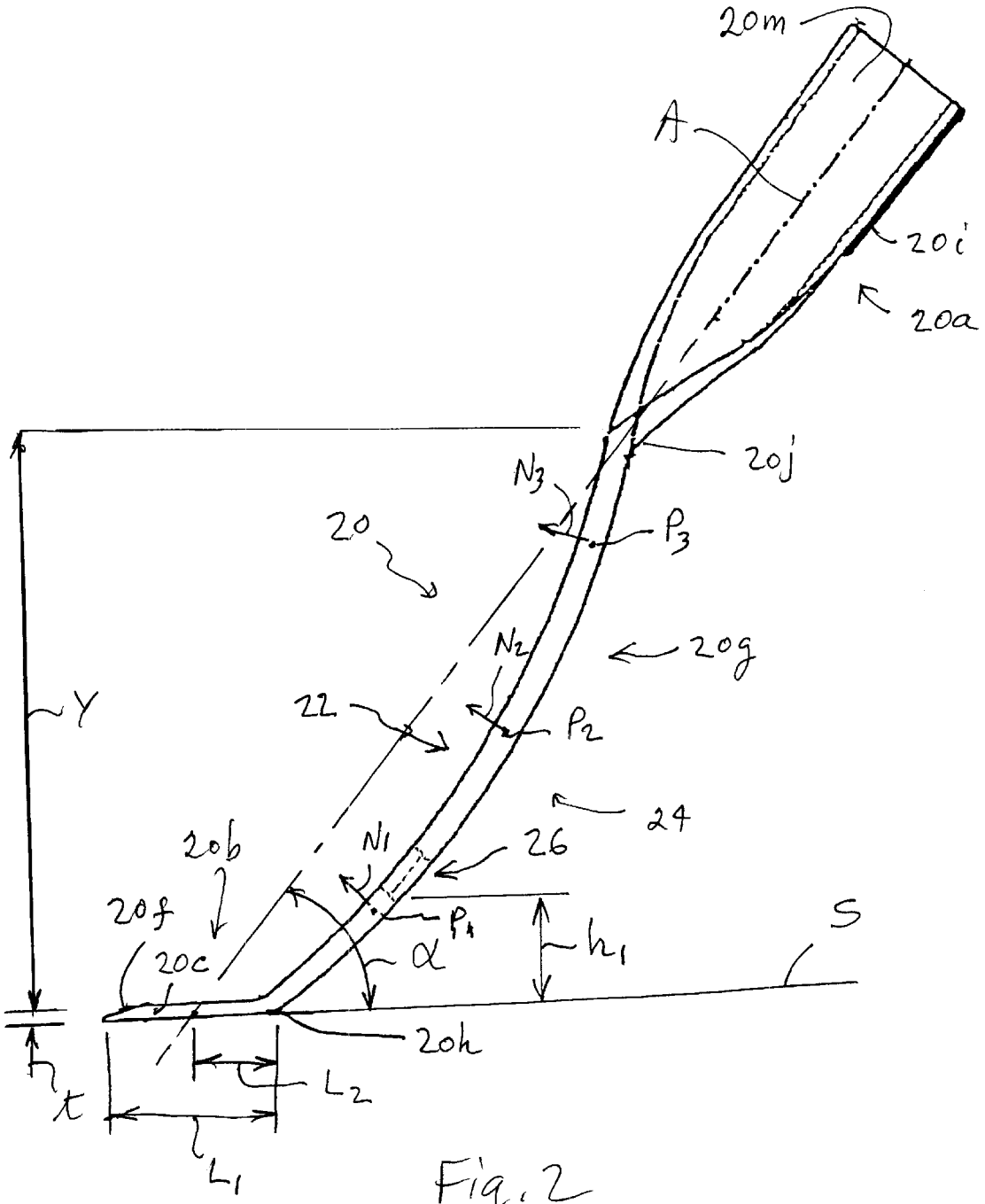
FIG. 2 is an enlarged side elevational view of the cutting head in accordance with the present invention, showing the leading flat portion lying flat on a surface on which roofing shingles are mounted.

Referring now specifically to the Figures, in which identical or similar parts are designated by the same reference numerals throughout, and first referring to FIGS. 1 and 2, a shingle removal tool in accordance with the present invention for removing shingles secured to a surface by means of nails is generally designated by the reference numeral 10.

The tool 10 includes an elongate handle 12 that defines a handle axis A and is provided with a hand grip 14 at one axial end of the handle for facilitating the gripping of the handle by the user that can be secured by a screw 16. A cutting head 20 is generally aligned with the handle axis and has an upper end 20*a* secured to the other axial end of the handle 12.

A lower end 20*b* of the cutting head 20 is formed with a generally flat leading portion 20*c* integrally connected to the upper end 20*a* by means of an intermediate portion 20*g*. The flat leading portion 20*c* defines a leading edge 20*d* generally transverse to the handle axis A and formed with a plurality of spaced-apart V-shaped slots 20*e* open at the leading or cutting edge 20*d* and extending rearwardly of the leading edge and dimensioned and configured to receive and engage nails when the leading flat portion 20*c* is in contact with and slides forwardly along a surface S and engaged secured shingles.

The leading and intermediate portions 20*c*, 20*g*, respectively, are angularly offset from each other, as best shown in FIG. 2, to form a fulcrum edge 20*h* generally parallel to the leading edge 20*d* as well as to orient the handle axis A at a predetermined angle a in relation to the surface S when the flat leading portion 20*c* lies flat on the surface. The fulcrum edge 20*h* serves to raise the leading edge 20*d* above the surface S by lowering the inclination of the handle 12 below the predetermined angle a in order to lift shingles and/or nails, as will be more fully discussed in connections with FIGS. 5 and 6.

One important feature of the present invention is that the intermediate portion 20*g* is curved, as best shown in FIG. 2, in a plane extending through the handle axis A and normal to the flat leading portion 20*c* to form a concave upper surface 22 which forms an inner side of the tool against which the shingles are deflected. A property of the concave upper surface 22 is that it defines normal directions $N_1$, $N_2$ and $N_3$ at points $p_1$, $p_2$ and $p_3$, respectively, the orientations of which increasingly approach the orientation of the plane of the flat leading portion 20*c*. Stated in a different way, the normal directions, when moving from the fulcrum edge 20*h* upwardly, as view in FIG. 2, increasingly move toward the horizontal direction or towards the left, as view in FIG. 2, which is the direction in which the tool is advanced during use.

In accordance with a presently preferred embodiment, the head intermediate portion 20*c* forms an arc of a circle having a center point, with the normal directions $N_1$, $N_2$ and $N_3$ defined by the concave upper surface 22 all being substantially directed towards said center point. Preferably, the circle of which the intermediate portion 20*g* forms an arc has a radius of approximately twice the vertical height Y of the intermediate portion 20*g* in relation to the plane of the leading flat portion 20*c*.

The leading flat portion 20*c*, at the cutting edges 20*d*, is preferably provided with upper tapers 20*f* which are sufficiently sharp and strong to shear small nails during normal removal activities.

While the specific manner of attaching the handle 12 to the cutting head 20 is not critical for purposes of the present invention, the cutting edge 20, formed of a substantially flat material, is rolled to provide a neck 20*i*, starting at the transition region 20*j* to produce a tubular elongate channel or socket at 20*m*. The handle 12 is preferably provided with a taper 12*c* at the axial end connected to the cutting head 20 to facilitate insertion of the handle into the neck 20*i* of the cutting head. Preferably, the resulting butted edges are permanently joined to each other by means of a weld 20*k*, shown in FIG. 1. To ensure safety of use of the tool and to render same more reliable, suitable means may be used to ensure that the handle does not separate from the cutting head 20 notwithstanding that such handle may be force- or press-fitted within the channel or socket 20*m*. A suitable fastener, such as a screw 21, may be inserted into the free end 12*b* of the handle which extends beyond the tubular channel or socket, such screw having a head which remains engaged with the inner edges of the neck 20*i* to prevent separation from the handle.

While most nails encountered by the tool will normally be removable by the V-shaped notches 20*e* or sheared by the cutting edges 20*d*, there are, on occasion, larger nails that are either too long to be pulled out or too thick to be sheared by the leading flat portion 20*c*. A feature of the present invention is the provision of suitable means on the intermediate portion 20*g* to access such longer nails from the lower or outer convex side 24. Such nail-engaging feature is generally designated by the reference numeral 26 and, referring to FIG. 2, is spaced a predetermined height $h_1$ above the flat leading portion 20*c* for engaging and removing nails. As indicated, such nails to be engaged and removed by the intermediate portion 20*g* are generally larger than nails intended to be removed by the flat leading portion 20*c*.

Figure 8:
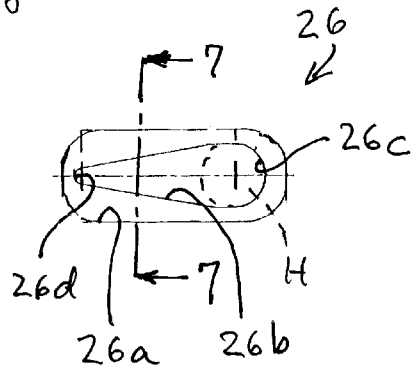
FIG. 8 is an enlarged view of the nail-removing opening shown in FIG. 7.
Figure 9:
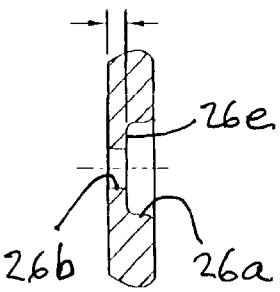
FIG. 9 is a cross sectional view taken along line 7—7 in FIG. 8.
Figure 7:
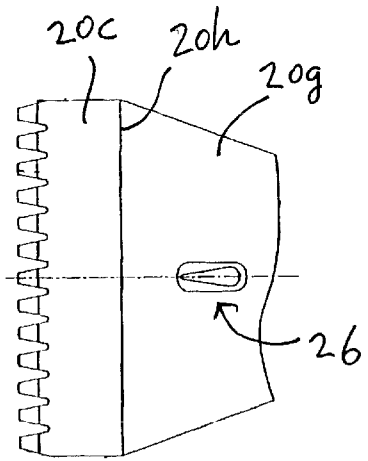
FIG. 7 is a bottom plan view of the leading portion of a modified cutting head, showing a nail-removing opening for removing nails larger than those intended to be removed by the leading or cutting edge.

Referring to FIGS. 7–9, the nail-removing opening 26 is shown in the form of an aperture formed in the wall of the intermediate portion 20*g* for receiving the head and shank of a nail and selectively retaining the head of the nail prior to lifting the handle 12, thereby pulling the nail up with the handle. The aperture is in the form of an elongate recess or slot 26*a* in the upper concave side or surface 22 of the intermediate portion 20*j* and generally parallel to the handle axis A.

A tapered hole 26*b* is provided, which is generally centered within the elongate recess 26*a* and includes a larger rounded end 26*c* and a smaller rounded end 26*d*, best shown in FIG. 8. As best shown in FIG. 9, the tapered hole 26*b* in combination with the elongate slot or recess 26*a* form a shoulder 26*e* between opposing surfaces, inner side 22 and outer side 24 of the intermediate portion 20*g* and dimensioned to permit passage of the head H of a nail, shown in phantom outline in FIG. 8, which can be initially introduced through the enlarged end 26*c* of the tapered hole 26*b*. After the head of the nail has penetrated through the intermediate portion 20*g* to a point above the shoulder 26*e*, the cutting head 20 can be moved towards the right, as viewed in FIGS. 7 and 8, bringing the head H in abutment against the shoulder 26*e* at the smaller dimensioned 26*d* of the tapered hole. Now, by lifting the handle, an upward force is applied to the head of the nail as the cutting head 20 pivots in a counterclockwise direction, as viewed in FIG. 2. It is clear that the further removed the aperture 26 is from the fulcrum edge 20*h*, the larger the size of the nails that can be pulled. However, at the same time, the leverage or mechanical advantage decreases. It has been found that an optimum position for the nail-removing aperture 26 is approximately midway between the fulcrum edge 20*h* and the approximate midpoint $P_2$ of the arcuate surface forming the intermediate portion 20*g*. In this position, relatively large nails can be removed while still affording meaningful leverage to the user and thereby facilitating the removal of such large nails.

In the presently preferred embodiment, the elongate slot or recess 26*a* has a longitudinal length approximately 2.5 times the transverse width thereof. Also, in such presently preferred embodiment, the tapered hole 26*b* has rounded opposing longitudinal ends defining radii of curvature in the ratio of 4:1. By selecting the larger radius of curvature at 26*c* to be approximately 0.2 inches, and the radius of the smaller end 26*d* to be approximately 0.05 inches, most roofing nails that are anticipated to be encountered can be received within the nail-removing aperture and easily and conveniently be removed.

Referring to FIG. 2, the leading flat portion 20*c* is shown to have a depth or dimension between the cutting edge 20*d* and the fulcrum edge 20*h* to be $L_1$. Another feature of the invention is that the flat leading portion 20*d* and the intermediate portion 20*g* are so dimensioned and configured so that the handle axis A intersects the flat leading portion 20*c* at a point substantially midway between the leading and fulcrum edges 20*d*, 20*h*. Thus, the point of intersection of the axis A and the leading flat portion 20*c* is spaced a distance $L_2$ from the fulcrum edge 20*h*, by selecting $L_2$ to be approximately one half of $L_1$. With such a configuration, a force component F applied by a user along the axis A will ensure that the leading flat portion 20*c* remains in contact with the surface S and wedge underneath shingles and/or nails, while at the same time applying a substantial force component in the forward direction needed to pry the shingles upwardly and shear standard roofing nails. Additionally, the application of a force component through the midpoint or center of the leading flat portion 20*c* also minimizes the frictional forces at the cutting edge 20*d* or the fulcrum edge 20*h*. This provides a suitable balance that efficiently converts the user's efforts to effective operation of the tool.

The efficiency with which the tool can be used for the intended purpose is further enhanced by selecting the angle $\alpha$ to be within the range of 45°–55° for dimensions between the fulcrum edge 20*h* to the gripping handle 14, generally along a direction normal to the surface S, while the leading portion lies flat on the surface, within the range of 34–40 inches. This dimension is identified in FIG. 5 by the designation $h_2$. In the presently preferred embodiment, the angle a is equal to approximately 50°, while the dimension $h_2$ is approximately 29 inches.

The shingle removing tool, with $\alpha$=50° and $h_2$ approximately 38 inches positions the hand grip at a height most comfortable and practical for a person of average height, which is approximately 68.3 inches. M. Sanders, E. J. McCormick, Human Factors in Engineering and Design.

Figure 5:
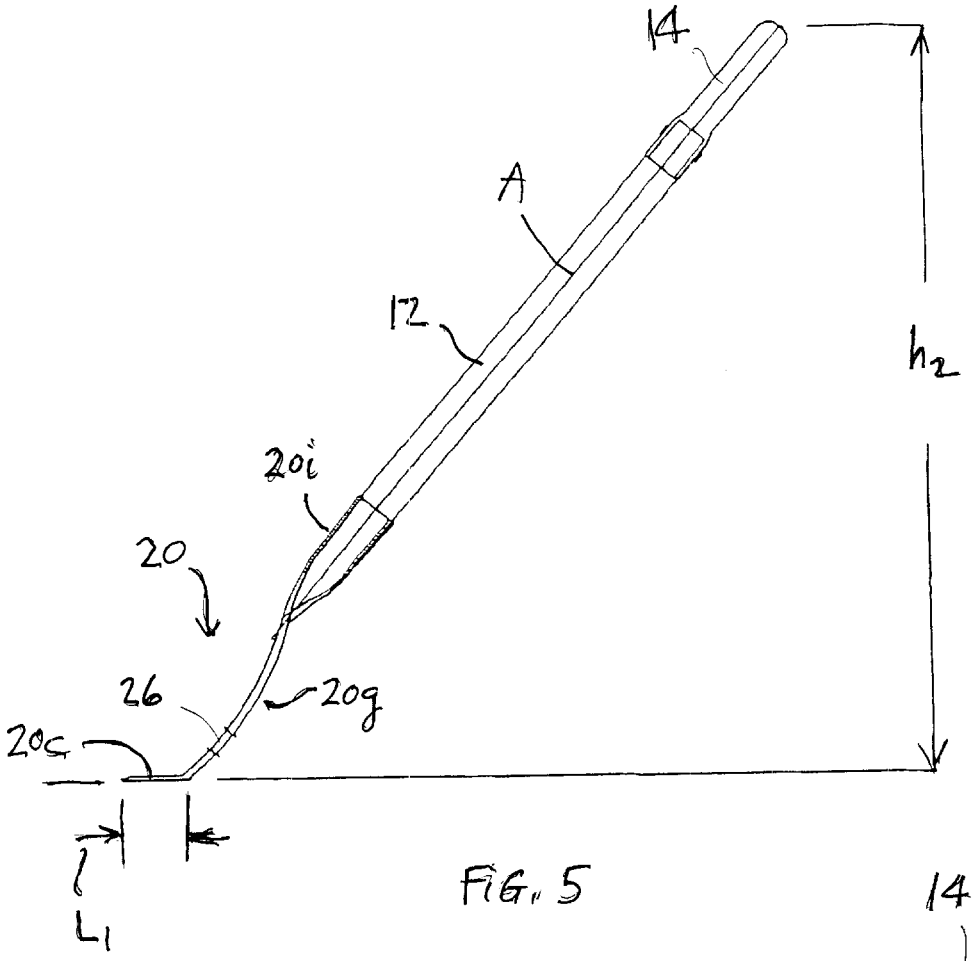
FIG. 5 is a side elevational view of the tool for removing shingles in accordance with the present invention, shown as it is normally positioned and advanced by a user to engage shingles and the nails holding the same by sliding the tool on a surface.
Figure 6:
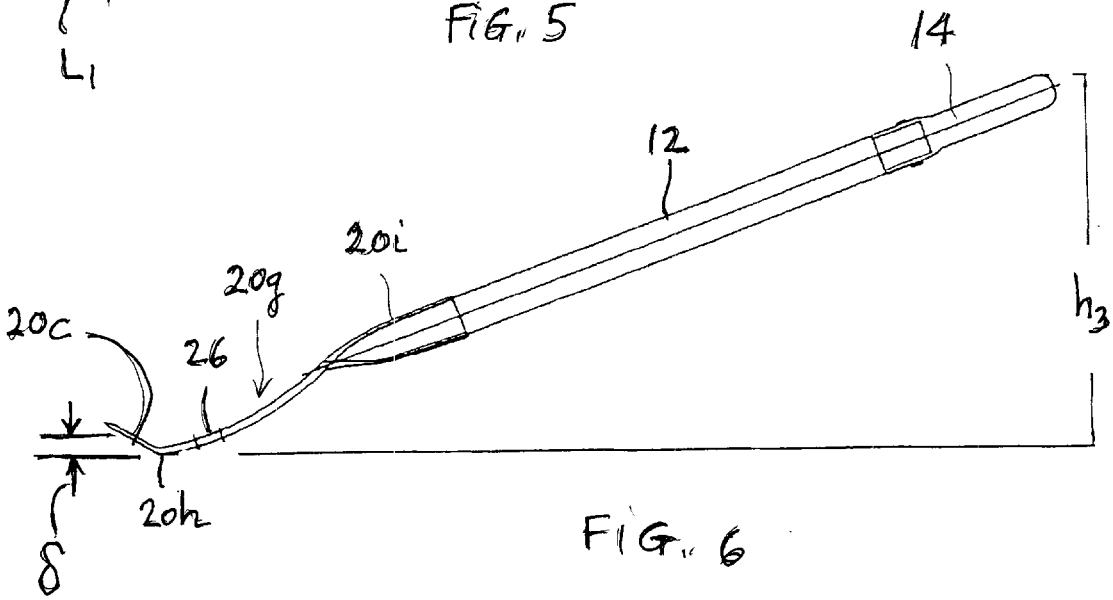
FIG. 6 is a view similar to FIG. 5, but illustrating the tool handle lowered to raise the leading flat portion when same is wedged below a shingle and/or nail to pry the same and remove the same from the roof.

It has been determined that by configuring the shingle removing tool as described, the tool is most comfortable and can be most effectively used by most adults to efficiently convert input effort to advancing the tool and removing shingles and nails while comfortably lowering and raising the tool, as suggested in FIGS. 5 and 6. When the handle is dropped to a height $h_3$, the leading flat portion 20*c* rises due to pivoting about the fulcrum edge 20*h* a distance $\delta$ (FIG. 6), which equals approximately 1⅛ inches. This elevation of the leading flat portion is adequate for removing most roofing nails. As indicated, if the nails are substantially larger, the nail-removing aperture 26 can be used.

Figure 3:
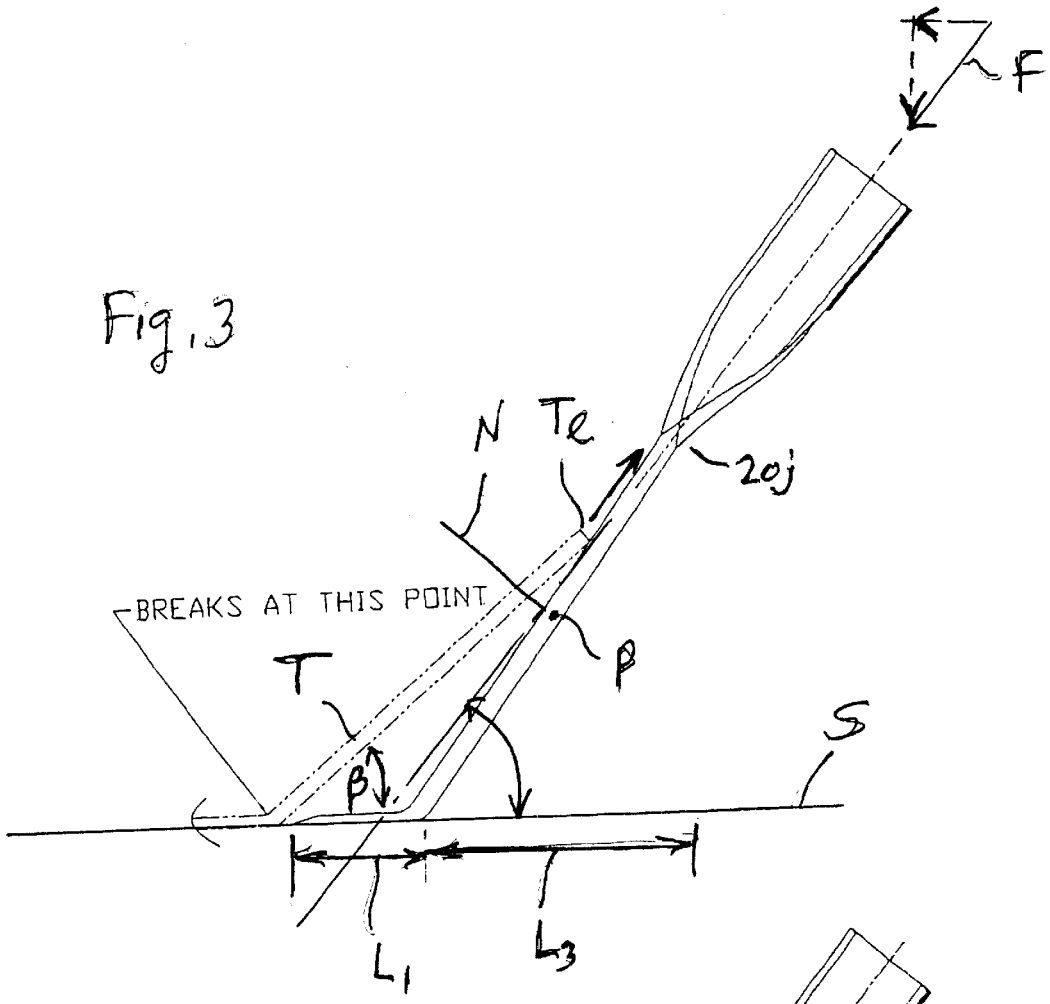
FIG. 3 is a view similar to FIG. 2, but showing the manner in which a conventional tool for removing roofing shingles deflects such shingles and increases the likelihood that such shingles will be broken and propelled rearwardly to the back of the tool.
Figure 4:
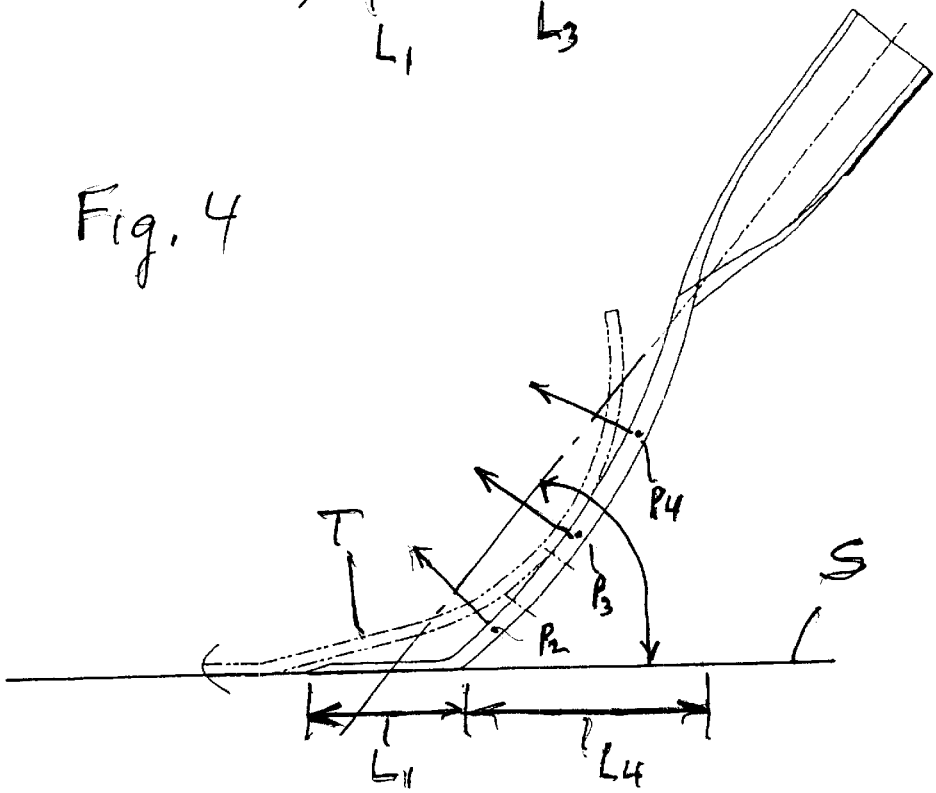
FIG. 4 is a view similar to FIG. 3, but showing the manner in which the removal tool in accordance with the present invention deflects the shingles by imparting a curvature thereto and deflecting the shingles forwardly away from the direction of the user.

Referring to FIG. 3, a conventional cutting head is illustrated in which the intermediate portion between the fulcrum edge and the transition region 20*j* is flat. With such a design, a shingle T, pried upwardly by the leading flat portion, causes the leading edge $T_1$ the shingle $T_1$ to ride or slide upwardly on the linear transition portion. However, because the slope of the intermediate portion tends to be relatively low, the normal N acting on the shingle has a relatively high upwardly-directed component. Consequently, the shingle climbs upwardly on the tool while remaining substantially straight. However, it is clear that the further up the leading edge $T_1$ of the shingle rises, the larger the angle $\beta$ becomes. Finally, at a critical value of $\beta$ for a given shingle, the shingle will break or crack at a point where the deflection takes place. However, because the shingle remains substantially flat it tends to be fragmented and propelled rearwardly in the direction of the user. By contrast, referring to FIG. 4, the normal directions for the intermediate portion 20*g* in the tool in accordance with the invention point towards a single center point. The shingles, which normally tend to be somewhat flexible, encounter normal force components which increasingly tend to bend and deflect the shingle forwardly.

The ratio of the dimensions between the leading and the fulcrum edges, $L_1$ and in FIG. 2, and the fulcrum edge to the gripping handle generally along the handle axis, is approximately within a range of 0.04–0.05. By using dimensions within this range the leverage of the tip edge of the blade is specifically dimensioned and angled to accommodate standard roofing nails, and to allow removal of them to allow removal of them with an optimal amount of force and handle deflection or movement. Thus, nails can be lifted approximately 1⅛ inches for a downward deflection of the gripping handle by approximately 18 inches.

Preferably, the cutting head is made of steel. A presently preferred material for such cutting head is 1045 steel. Clearly, other materials having similar properties can be used.

During normal operation, the tool is oriented as illustrated in FIG. 5 to position the leading flat portion 20*c* flat on the surface S. This, as indicated, involves moving the handle axis to an angle of approximately 50° when the upper end of the hand grip is approximately 38 inches above the surface. With this orientation of the tool, it can be conveniently and efficiently moved by sliding same over the surface to wedge the leading flat portion 20*c* below the shingles as well as the heads of the nails retaining the same to the surface. Once wedged below the elements to be removed, the handle is lowered, as suggested in FIG. 6, tilting the tool about the fulcrum edge 20*h* to elevate the shingles and/or nails. If a nail is too long and the distance $\delta$ is not sufficient to remove the nail, the nail-engaging aperture 26*c* may be used to engage the head of a nail, as aforementioned, and the handle 12 then raised about the fulcrum point 20*h* to the position shown in FIG. 5 to remove such problematic nails. It is noted that the differences in the positions of the handle grip above the surface varies approximately 18 inches, an increment that is comfortable for the average-height person. The tool as described will also optimize the function of the tool as most of the efforts to push forward will be utilized in the removal process rather than wasted due to frictional forces. By having the force vector acting along the handle axis A, as discussed in connection with FIG. 2, the force factor extends substantially through the middle of the leading flat portion, this minimizing the force per unit area and, this, in turn, reducing the frictional forces. Also, as a result of the arcuate or curved intermediate portion 20*g*, the tool is designed to direct the removed debris to the front of the blade, as opposed to climbing up the blade and falling to the back of the blade, thereby allowing faster collection and removal of the debris and more convenient operation.

Although the present invention has been described in relation to particular embodiments thereof, many other variations, modifications and other uses will become apparent to those skilled in the art. It is the intention, therefore, that the present invention not be limited by the specific disclosure of the embodiments therein, but only by the scope of the appended claims.

What we claim:

1. A shingle removal tool for removing shingles secured to a surface by means of nails, comprising an elongate handle defining a handle axis and provided with gripping means at one axial end of said handle for facilitating the gripping of said handle by a user; and a cutting head generally aligned with said handle axis and having an upper end secured to the other axial end of said handle, a lower end of said cutting head being formed with a generally flat leading portion integrally connected to said upper end by means of an intermediate portion, said flat leading portion defining a leading edge generally transverse to said handle axis and formed with a plurality of spaced apart slots open at said leading edge and extending rearwardly of said leading edge and dimensioned and configured to receive and engage nails when said leading portion is in contact with and slides forwardly along said surface and engages secured shingles, said leading and intermediate portions being angularly offset from each other to form a fulcrum edge generally parallel to said leading edge as well as to orient said handle axis at a predetermined angle in relation to said surface when said flat leading portion lays flat on said surface, said fulcrum edge serving to raise said leading edge above said surface by lowering the inclination of said handle below said predetermined angle to lift shingles and/or nails in contact with said leading portion, said intermediate portion being curved in a plane extending through said handle axis and normal to said flat leading portion to form a concave upper surface defining normal directions from said fulcrum edge to said upper end that increasingly approach the orientation of the plane of said flat leading portion.

2. A tool as defined in claim 1, wherein said intermediate portion forms an arc of a circle having a center point, and normal directions defined by said concave upper surface that are substantially directed towards said center point.

3. A tool as defined in claim 2, wherein said circle has a radius of approximately twice the vertical height of said intermediate portion in relation to the plane of said flat leading edge.

4. A tool as defined in claim 1, wherein said cutting head is made of steel.

5. A tool as defined in claim 4, wherein the steel is 1045 steel.

6. A shingle removal tool as defined in claim 1, wherein said flat leading portion forms a continuously smooth concave upper surface from said fulcrum edge to said upper end.

7. A shingle removal tool for removing shingles secured to a surface by means of nails, comprising an elongate handle defining a handle axis and provided with gripping means at one axial end of said handle for facilitating the gripping of said handle by a user; a cutting head generally aligned with said handle axis and having an upper end secured to the other axial end of said handle, a lower end of said cutting head being formed with a generally flat leading portion integrally connected to said upper end by means of an intermediate portion, said flat leading portion defining a leading edge generally transverse to said handle axis and formed with a plurality of spaced apart slots open at said leading edge and extending rearwardly of said leading edge and dimensioned and configured to receive and engage nails when said leading portion is in contact with and slides forwardly along said surface and engages secured shingles, said leading and intermediate portions being angularly offset from each other to form a fulcrum edge generally parallel to said leading edge as well as to orient said handle axis at a predetermined angle in relation to said surface when said flat leading portion lays flat on said surface, said fulcrum edge serving to raise said leading edge above said surface by lowering the inclination of said handle below said predetermined angle to lift shingles and/or nails in contact with said leading portion, and nail engaging means on said intermediate portion spaced a predetermined height above said flat leading portion for engaging and removing nails, generally larger than nails intended to be removed by said flat leading portion, by lifting said handle about said fulcrum edge.

8. A tool as defined in claim 7, wherein said nail-engaging means comprises aperture means for receiving the head and shank of a nail and selectively retaining the head of the nail prior to lifting of said handle.

9. A tool as defined in claim 8, wherein said aperture means comprises an elongate recess in an upper surface of said intermediate portion and generally parallel to said handle axis, a tapered hole generally centered with said elongate recess and extending through said intermediate portion to form a shoulder between opposing surfaces of said intermediate portion and dimensioned to permit passage of the head of the nail to be pulled only at one longitudinal end of said recess, whereby the head of a nail can be engaged by said shoulder and the nail removed.

10. A tool as defined in claim 9, wherein said elongate recess has a longitudinal length approximately 2.5 times the transverse width thereof.

11. A tool as defined in claim 9, wherein said tapered hole has rounded opposing longitudinal ends defining radii of curvature in the ratio of 4:1.

12. A tool as defined in claim 9, wherein said tapered hole has rounded opposing longitudinal ends, the larger end having a radius of approximately 0.2 inches and the smaller end has a radius of approximately 0.05 inches.

13. A tool as defined in claim 7, wherein said nail-engaging means is approximately midway between said fulcrum edge and the center of said intermediate portion along said handle axis.

14. A shingle removal tool for removing shingles secured to a surface by means of nails, comprising an elongate handle defining a handle axis and provided with gripping means at one axial end of said handle for facilitating the gripping of said handle by a user; and a cutting head generally aligned with said handle axis and having an upper end secured to the other axial end of said handle, a lower end of said cutting head being formed with a generally flat leading portion integrally connected to said upper end by means of an intermediate portion, said flat leading portion defining a leading edge generally transverse to said handle axis and formed with a plurality of spaced apart slots open at said leading edge and extending rearwardly of said leading edge and dimensioned and configured to receive and engage nails when said leading portion is in contact with and slides forwardly along said surface and engages secured shingles, said leading and intermediate portions being angularly offset from each other to form a fulcrum edge generally parallel to said leading edge as well as to orient said handle axis at a predetermined angle in relation to said surface when said flat leading portion lays flat on said surface, said fulcrum edge serving to raise said leading edge above said surface by lowering the inclination of said handle below said predetermined angle to lift shingles and/or nails in contact with said leading portion, said flat leading and intermediate portions being dimensioned and configured so that said handle axis intersects said flat leading portion at a point substantially midway between said leading and fulcrum edges.

15. A shingle removal tool for removing shingles secured to a surface by means of nails, comprising an elongate handle defining a handle axis and provided with gripping means at one axial end of said handle for facilitating the gripping of said handle by a user; and a cutting head generally aligned with said handle axis and having an upper end secured to the other axial end of said handle, a lower end of said cutting head being formed with a generally flat leading portion integrally connected to said upper end by means of an intermediate portion, said flat leading portion defining a leading edge generally transverse to said handle axis and formed with a plurality of spaced apart slots open at said leading edge and extending rearwardly of said leading edge and dimensioned and configured to receive and engage nails when said leading portion is in contact with and slides forwardly along said surface and engages secured shingles, said leading and intermediate portions being angularly offset from each other to form a fulcrum edge generally parallel to said leading edge as well as to orient said handle axis at a predetermined angle in relation to said surface when said flat leading portion lays flat on said surface, said fulcrum edge serving to raise said leading edge above said surface by lowering the inclination of said handle below said predetermined angle to lift shingles and/or nails in contact with said leading portion, said predetermined angle being within the range of 45°–55° for dimensions between said fulcrum edge to said gripping means generally along said handle is within the range of 4 and 5 feet.

16. A tool as defined in claim 15, wherein said angle is approximately 50° and said dimension between said fulcrum edge and said gripping portion along said handle axis is approximately 48 inches.

17. A shingle removal tool for removing shingles secured to a surface by means of nails, comprising an elongate handle defining a handle axis and provided with gripping means at one axial end of said handle for facilitating the gripping of said handle by a user; and a cutting head generally aligned with said handle axis and having an upper end secured to the other axial end of said handle, a lower end of said cutting head being formed with a generally flat leading portion integrally connected to said upper end by means of an intermediate portion, said flat leading portion defining a leading edge generally transverse to said handle axis and formed with a plurality of spaced apart slots open at said leading edge and extending rearwardly of said leading edge and dimensioned and configured to receive and engage nails when said leading portion is in contact with and slides forwardly along said surface and engages secured shingles, said leading and intermediate portions being angularly offset from each other to form a fulcrum edge generally parallel to said leading edge as well as to orient said handle axis at a predetermined angle in relation to said surface when said flat leading portion lays flat on said surface, said fulcrum edge serving to raise said leading edge above said surface by lowering the inclination of said handle below said predetermined angle to lift shingles and/or nails in contact with said leading portion, the ratio of the dimension between said leading and fulcrum edges and the fulcrum edge to said gripping means generally along said handle axis is approximately within the range of 0.04 and 0.05.

18. A tool as defined in claim 17, wherein said flat leading portion and said handle are dimensioned to lift nails by approximately 1⅛ inches when said gripping means is lower approximately 18 inches.

* * * * *